US009314055B2

(12) United States Patent
Moran

(10) Patent No.: US 9,314,055 B2
(45) Date of Patent: Apr. 19, 2016

(54) ARTICLE OF CLOTHING

(71) Applicant: Timothy Moran, Soquel, CA (US)

(72) Inventor: Timothy Moran, Soquel, CA (US)

( * ) Notice: Subject to any disclaimer, the term of this patent is extended or adjusted under 35 U.S.C. 154(b) by 85 days.

(21) Appl. No.: 14/081,447

(22) Filed: Nov. 15, 2013

(65) Prior Publication Data

US 2014/0157490 A1 Jun. 12, 2014

Related U.S. Application Data

(60) Provisional application No. 61/734,659, filed on Dec. 7, 2012.

(51) Int. Cl.
*A41D 1/06* (2006.01)
*A41B 11/00* (2006.01)

(52) U.S. Cl.
CPC ..... *A41D 1/06* (2013.01); *A41B 11/007* (2013.01)

(58) Field of Classification Search
CPC ..... A41D 13/06; A41D 1/06; A41B 11/03
USPC ..... 2/80, 83, 239
See application file for complete search history.

(56) References Cited

U.S. PATENT DOCUMENTS 482,095 A * 9/1892 Bernstein ..... 66/187
569,483 A * 10/1896 Arnold ..... A41D 10/00 2/83
904,383 A * 11/1908 Loven ..... 2/83
1,112,759 A * 10/1914 Junker ..... 2/83
1,283,205 A * 10/1918 Morse ..... 2/83
1,393,900 A * 10/1921 Milkes ..... 2/83
1,525,473 A * 2/1925 Thomas ..... 2/83
1,794,850 A * 3/1931 Hatch ..... 2/83
2,131,898 A * 10/1938 Milkes ..... 2/83
2,371,584 A * 3/1945 Marrow et al. ..... 2/83
2,552,802 A * 5/1951 Martin ..... 36/9 R
2,655,660 A * 10/1953 Racz ..... 2/83
2,705,326 A * 4/1955 Lahnstein et al. ..... 2/83
2,705,804 A * 4/1955 Walker ..... 2/83
2,738,512 A * 3/1956 Winer ..... 2/80
3,090,963 A * 5/1963 Wittman ..... 2/239
3,111,676 A * 11/1963 Artzt et al. ..... 2/80
3,201,800 A * 8/1965 McHugh ..... 2/83
3,653,074 A * 4/1972 Nobile et al. ..... 2/80
3,975,929 A * 8/1976 Fregeolle ..... 602/63
4,149,274 A * 4/1979 Garrou et al. ..... 2/239
4,424,596 A * 1/1984 Jackson ..... 2/240
4,475,253 A * 10/1984 Laveckis ..... 2/269
5,054,129 A * 10/1991 Baehr ..... 2/409
5,125,117 A * 6/1992 Buenos et al. ..... 2/239
5,575,013 A * 11/1996 Krack ..... 2/239
6,047,571 A * 4/2000 Juniman ..... 66/178 A
6,324,698 B1 * 12/2001 Freeman ..... 2/239
7,007,309 B1 * 3/2006 Mende ..... 2/239
7,533,424 B2 * 5/2009 Symonds-Powell ..... 2/239
8,356,365 B2 * 1/2013 Wolfson ..... 2/80
2002/0108166 A1 * 8/2002 Abboud ..... 2/239
2008/0168683 A1 * 7/2008 Keating ..... 36/102
2009/0300823 A1 * 12/2009 Connaghan et al. ..... 2/239
2011/0289656 A1 * 12/2011 Witte ..... A41B 11/006 2/239
2013/0174325 A1 * 7/2013 Yang et al. ..... 2/239
2013/0291293 A1 * 11/2013 Jessiman et al. ..... 2/459

* cited by examiner

*Primary Examiner* — Richale Quinn
(74) *Attorney, Agent, or Firm* — Donald R. Boys; Central Coast Patent Agency, Inc.

(57) ABSTRACT

An article of clothing includes a waist band, a seat portion, two pant legs, and two foot coverings disposed one each at the end of the pant legs. The foot coverings each include an opening of a size suitable for extending the foot through the foot coverings to the outside while wearing the article of clothing.

10 Claims, 6 Drawing Sheets

ARTICLE OF CLOTHING

CROSS-REFERENCE TO RELATED DOCUMENTS

The present invention claims priority to a U.S. provisional patent application 61/734,659, entitled "Method and Apparatus for Incorporating Booties with Clothing Bottoms", filed on Dec. 7, 2012, disclosure of which is incorporated herein at least by reference.

BACKGROUND OF THE INVENTION

1. Field of the Invention The present invention is in the field of clothing including sweatpants and sleepwear and pertains particularly to methods and apparatus for providing foot coverings with at least one opening for extending the foot through the covering to the outside.

2. Discussion of the State of the Art

In the field of retail clothing, more particularly sweatpants and sleepwear, pants exist that include foot coverings commonly referred to as booties on the end of the pant legs. Booties completely cover the foot when wearing such articles of clothing. One problem with the booties is that under certain circumstances the wearer's feet become too warm while wearing the article necessitating removal of a portion of or the entire article of clothing.

Therefore, what is clearly needed is an article of clothing including booties or footies that solves the above mentioned problem.

SUMMARY OF THE INVENTION

A clothing article includes a waist band, a seat portion, two pant legs, and two foot coverings disposed one each at the end of the pant legs. The foot coverings each include an opening of a size suitable for extending the foot through the foot coverings to the outside while wearing the clothing article. In one embodiment, the waist band includes a drawstring for drawing the waist tight.

In one embodiment, the foot coverings have soles made of resilient material. In one embodiment, the foot coverings are lined on the inside with Sherpa material. In one embodiment, a portion of each pant leg is lined on the inside at least partially with fleece the fleece extending at least partially into the foot coverings.

In one embodiment, the opening is disposed horizontally across the sole of each foot covering substantially centered between the heel and toe of the foot covering. In one embodiment, the clothing article further includes a rubberized ink covering the sole of each foot covering. In a variation of this embodiment the rubberized ink is applied according to a tread pattern.

In another embodiment, the opening is disposed horizontally across the heel of the sole portion of each foot covering. In another embodiment, the opening is disposed along the longitudinal centerline of the sole of the foot covering between the heel and toe of the foot covering. In another embodiment, the opening is disposed at one or the opposing edge of the sole portion of the foot covering. In another embodiment, the opening is disposed across the back of the foot covering above the heel. In yet another embodiment the opening is disposed along the top of the foot covering and oriented in the heel-to-toe direction.

BRIEF DESCRIPTION OF THE DRAWING FIGURES

DETAILED DESCRIPTION

The inventor provides an article of clothing, in one embodiment, sweatpants that include foot coverings with openings provided therein for the feet to be optionally extended through to the outside. The present invention is described in enabling detail using the following examples, which may describe more than one relevant embodiment falling within the scope of the present invention.

Figure 1:
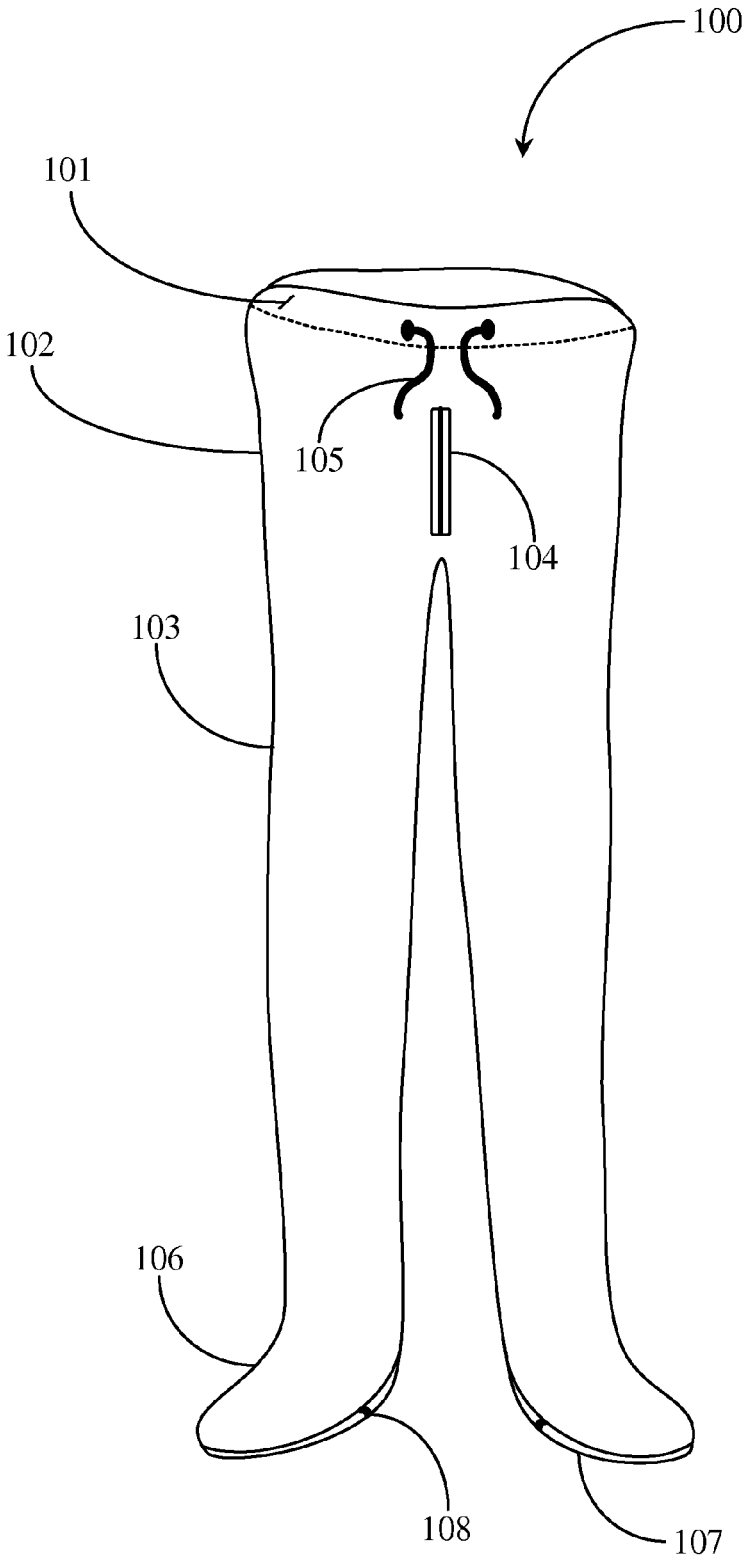
FIG. 1 is an elevation view of an article of clothing according to an embodiment of the present invention.

FIG. 1 is an elevation view of a clothing article 100 according to an embodiment of the present invention. Clothing article 100, in this embodiment, is a garment commonly referred to as sweatpants in the art. Sweatpants 100 may be fabricated of a durable and soft material such as a cotton blend interwoven with an absorbent heat retention material like fleece. Clothing article 100 includes a waist band 101. Waist band 101 may include drawstrings 105. Drawstrings 105 may be utilized to tighten the clothing article, in this case sweatpants, at the waist. In another embodiment waistband 101 is fabricated from an elastic stretchable material. In one embodiment sweatpants 100 include a seat or seat portion 102. Seat portion 102 may be reinforced, lined, or padded with supplemental materials in one embodiment. In another embodiment the seat is fabricated from the same material as the sweatpants.

In one embodiment, sweatpants 100 include a fly 104. Fly 104 may be a flap opening, a zippered opening, or a buttoned opening without departing from the spirit and scope of the present invention. In one embodiment sweatpants 100 may include one or more pockets (none illustrated) without departing from the spirit and scope of the present invention. In one embodiment sweatpants 100 may be attached to a top garment such as a sweat jacket, wind breaker, or some other top garment. Mechanisms of attaching sweatpants to a garment top piece might include hook and loop, snaps, buttons, hooks, zipper, or the like.

Sweatpants 100 include pant legs 103. Pant legs 103 may include fleece material for retaining warmth and absorbing moisture. Each pant leg culminates into a foot covering 106. Foot covering 106 is sewn into pant leg 103 in this embodiment. In another embodiment foot covering 106 may be a contiguous part of the sweatpants material. Foot covering 106 completely encloses the wearer's foot. Foot covering 106 may also be referred to in the art as a bootie or footie.

Foot covering 106 in one embodiment includes an opening 108 provided on the sole of the foot covering in a direction substantially orthogonal to the direction of the wearer's foot. In this view only a far end of the opening is visible. Opening 108 is adapted to enable the wearer to extend the foot through the opening to the outside. Opening 108 may be provided through a resilient stretch material 107 that is used to fabricate the sole of foot covering 106. More detail about opening 108 is included later in this specification.

Figure 2:
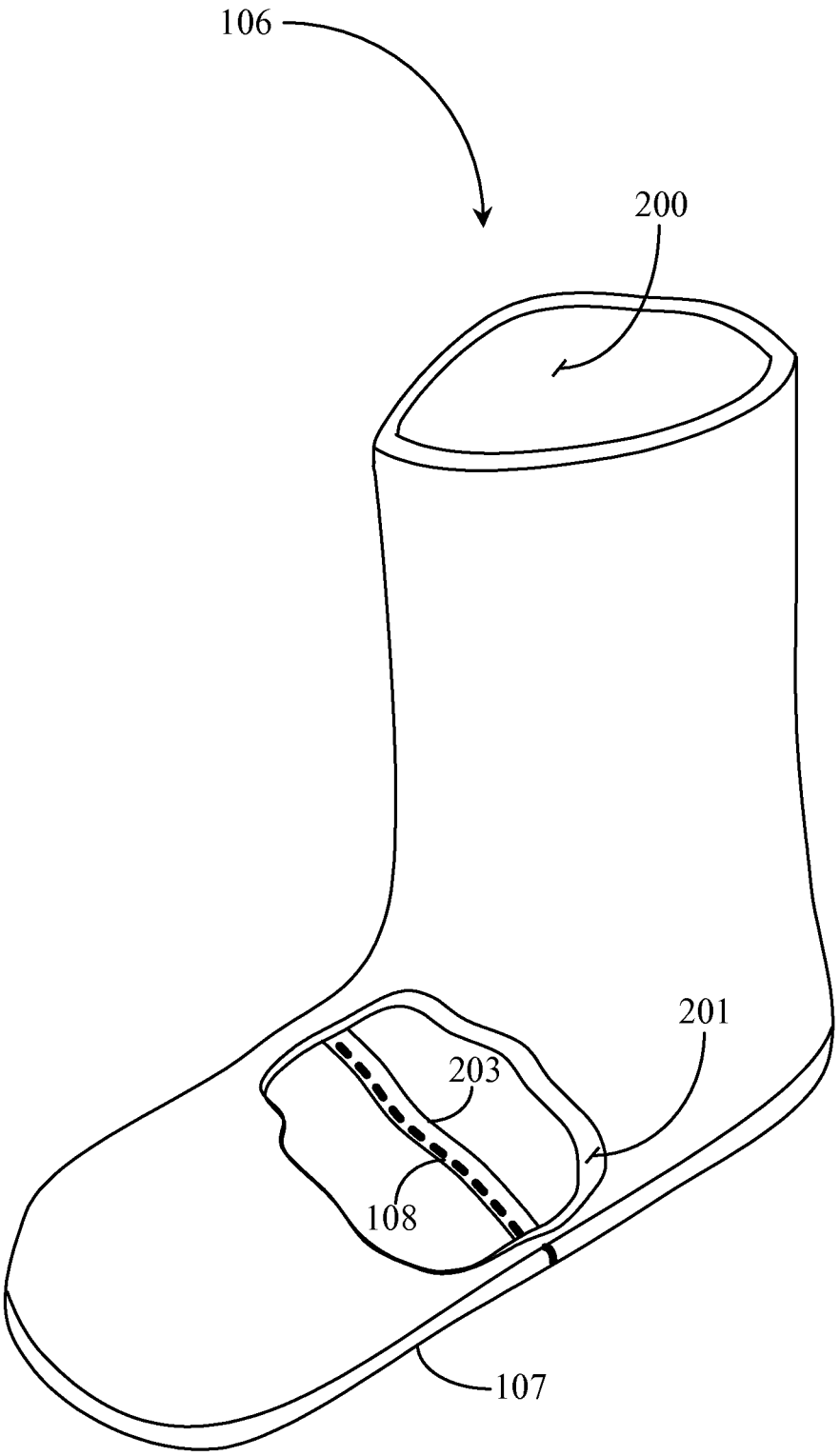
FIG. 2 is a perspective view of a foot covering of the article of clothing of FIG. 1.

FIG. 2 is a perspective view of foot covering 106 of the clothing article of FIG. 1. Foot covering 106 is depicted separated from sweatpants 100 to illustrate more detail. Foot covering 106 is separated above the ankle region in this example and depicts a fleece lining 200 that may or may not extend into the foot covering to just above or approximately near the ankle region of the bootie. In this embodiment a portion of foot covering 106 is removed to expose opening 108. The foot portion or region of foot covering 106 may, in one embodiment, be lined on the inside with a Sherpa material 201. Sherpa is a commonly used synthetic material designed to retain warmth and absorb moisture.

Opening 108 may be a slit opening provided through the sole of foot covering 106, in this case, across the sole of the foot covering substantially orthogonal to the direction of the foot in the bootie. Opening 108 may be a "hidden opening" covered by a flap 203. Opening 108 may be held together by a fastening mechanism such as a hook and loop connection, snaps, zipper, magnetic strip, buttons, or the like, but may in some embodiments not be fastened. In one embodiment opening 108 is provided with protective flaps or coverings on both the upper surface and bottom surface of the sole of the foot covering. The protective flaps may keep foreign material from entering the opening through the bottom of the sole and also may protect fasteners such as snaps or buttons from direct contact with the floor or ground surface while walking with the feet inside the foot coverings.

In one embodiment, the opening 203 is not fastened or otherwise closed. In this embodiment protective flap materials may be provided to cover the opening. In another embodiment opening 108 may be provided roughly centered in a Z-cut design provided vertically through the sole of the foot covering that provides a contiguous flap or stretch material on both sides of the opening. This configuration may also include a zipper or other fastening mechanism operated from the outside of the foot covering to close the opening. Such a mechanism might be accessible by lifting the flap on the bottom sole. In another embodiment foot covering 106 might be detachable from sweatpants 106.

Figure 3:
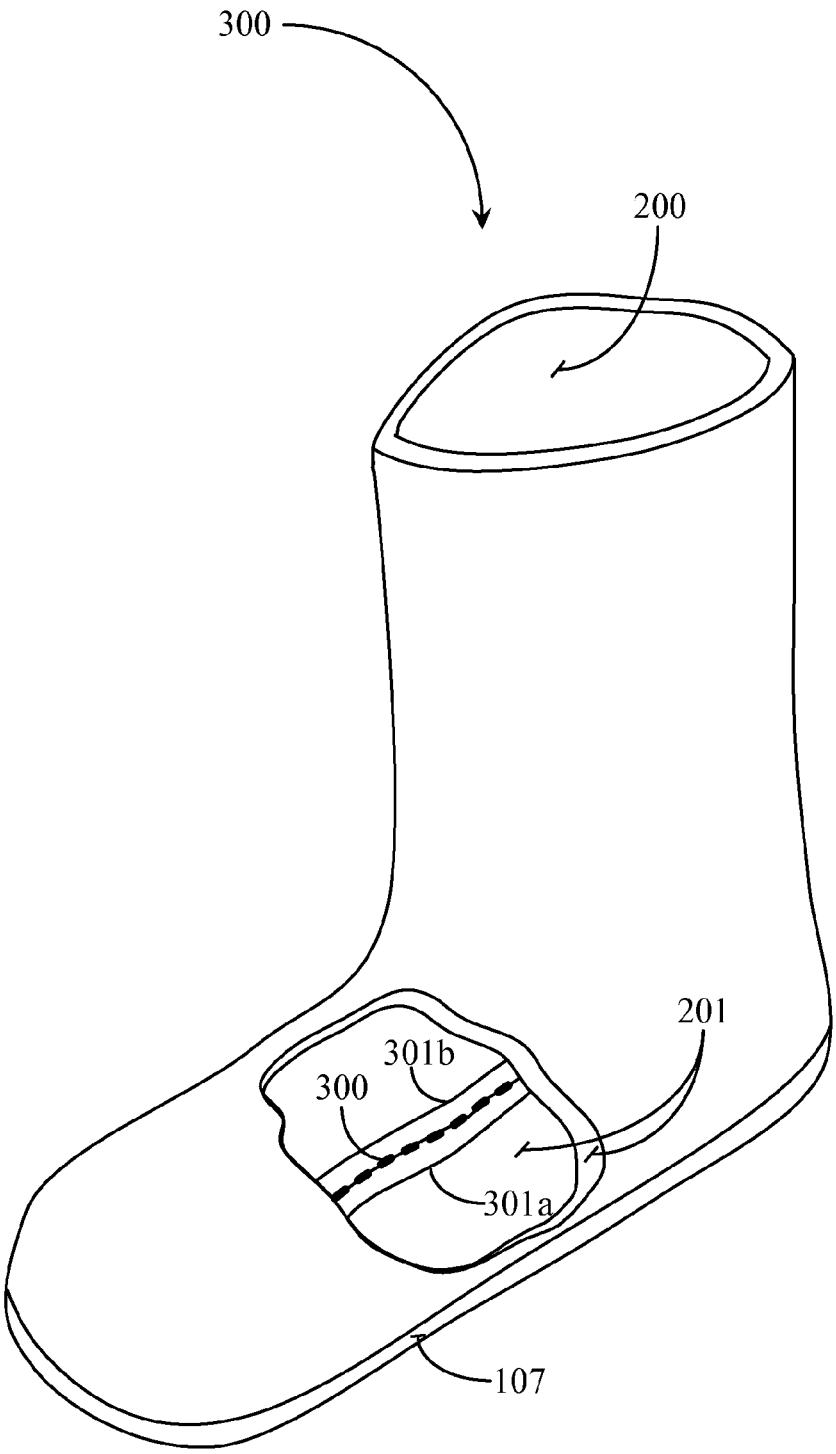
FIG. 3 is a perspective view of a foot covering according to another embodiment of the present invention.

FIG. 3 is a perspective view of a foot covering 300 according to another embodiment of the present invention. Foot covering 300 is analogous to foot covering 106 of FIG. 1 with the exception of the orientation of the opening. Foot covering 300 includes fleece material 200 and Sherpa material 201, as well as resilient stretch material 107.

In this embodiment an opening 300 is provided through the sole of foot covering 300 in a direction substantially in line with the foot inserted into the bootie. In this case opening 300 is covered by material flaps 301*a* and 301*b*. Opening 300 may be of a length sufficient to allow a user to fully extend the foot through the covering to the outside. Opening 300 may be protected on the bottom side of the sole by rubberized flaps or a contiguous flap such as with a Z-cut design placed through the sole bottom and enclosing the opening with a flap on the bottom and one on the inside of the sole.

Figure 4:
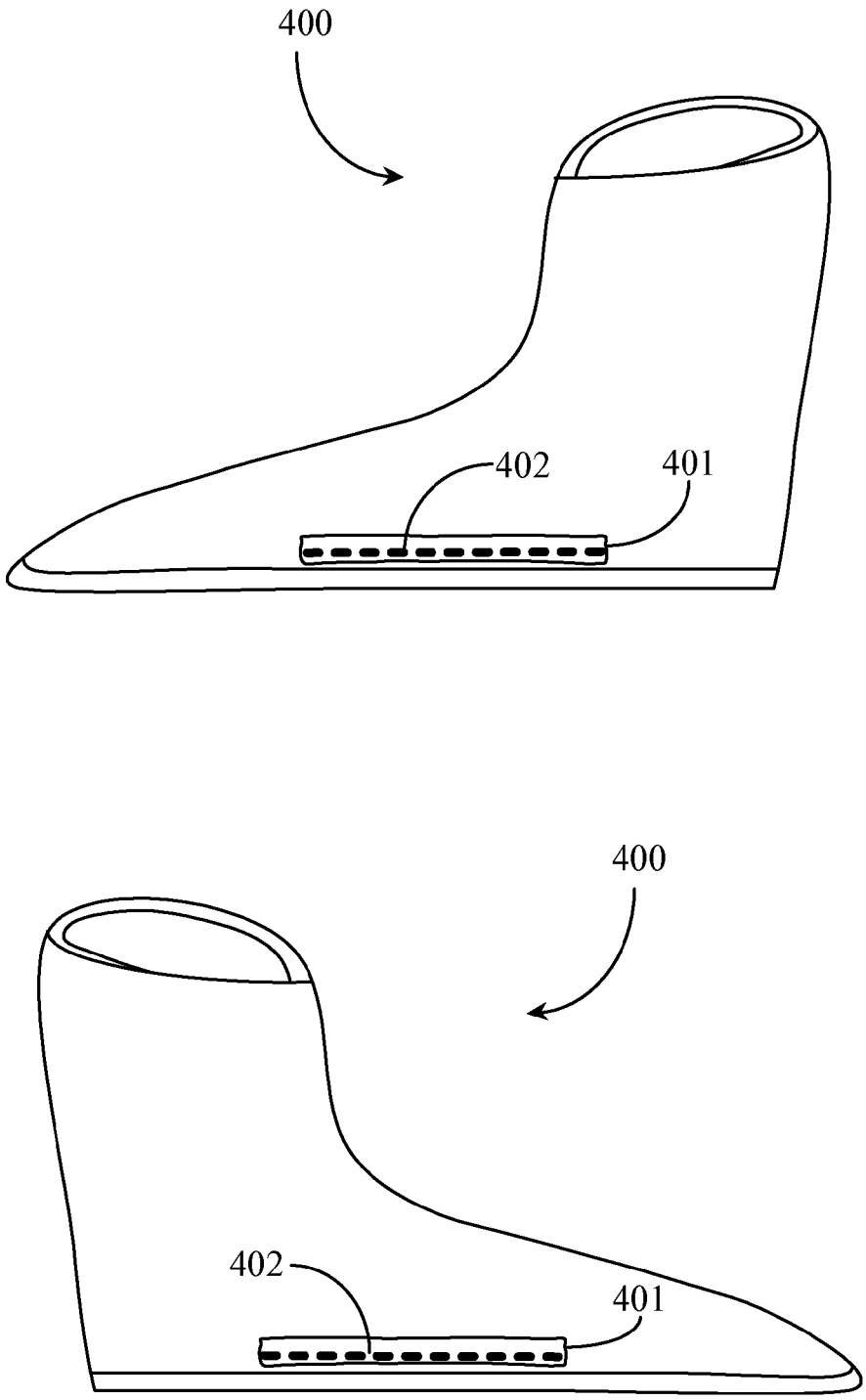
FIG. 4 is an elevation view of a foot covering according to another embodiment of the present invention.

FIG. 4 is an elevation view of a foot covering 400 according to another embodiment of the present invention. Foot covering 400 is analogous in description to foot coverings described further above with the exception of the orientation of the opening. In this embodiment an opening 402 is provided through the side of foot covering 400 instead of through the sole of the covering as was described further above. In this embodiment opening 401 may be provided on the "left" side or on the "right" side of the bootie just above and parallel to the sole of the bootie.

In one embodiment foot covering 400 has two openings, one opening provided on the "left" side and one opening provided on the "right" side of the bootie. Opening 401 is protected by a flap 401. In this view the opening flap 401 is visible on the outside surface of the foot covering. The opening may also be protected by a similar flap on the inside of the bootie. In one embodiment the sole portion of foot covering 400 is extended to a portion of the side of the covering in area sufficient to support the length of and location of the opening. In this way the opening is still provided through the material comprising the sole of the foot covering.

Figure 5:
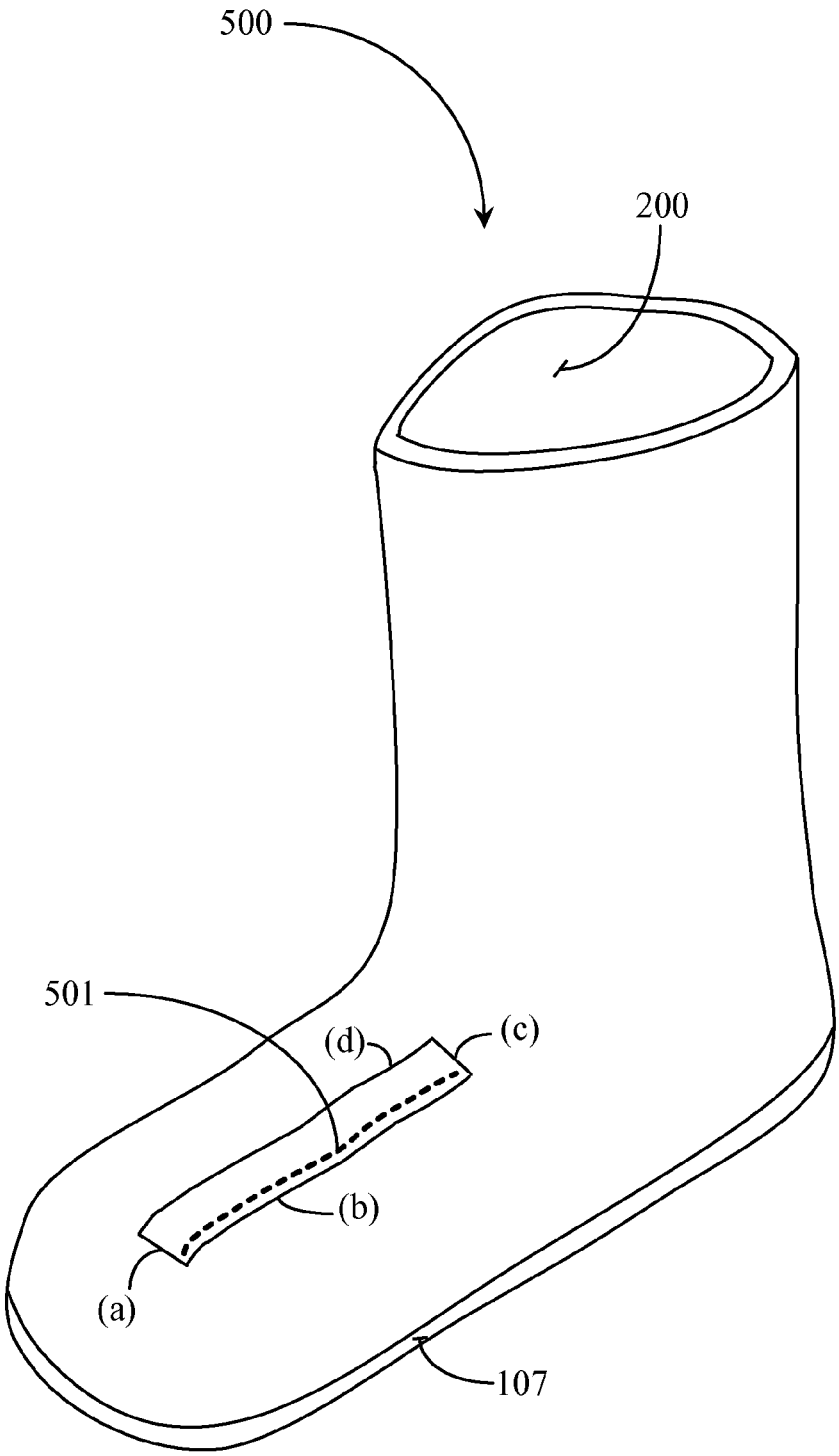
FIG. 5 is a perspective view of a foot covering according to another embodiment of the invention.

FIG. 5 is a perspective view of a foot covering 500 according to another embodiment of the present invention. Foot covering 500 is analogous in description to foot coverings described further above with the exception of the orientation of the opening. In this embodiment an opening 501 is provided through the top of foot covering 500 instead of through the sole of the covering, or elsewhere as was described further above. In this embodiment opening 401 may be oriented across the top, in the direction of the foot as shown in FIG. 5, or at any other angle. Opening 501 is made by slitting the top material of the foot covering for a specific length, and then sewing a flap defined by sides (a), (b), (c) and (d) to the material of the top of the foot covering along sides (a), (b) and (c), but not (d).

Other areas of the foot covering may also be considered for hosting such an opening without departing from the spirit and scope of the present invention. For example, opening 402 could be provided closer to the heel or toe of the foot covering. Opening 402 might be provided across the back portion of the foot covering above the heel of the bootie. Opening 402 may be provided across the top surface of the bootie in line with or orthogonal to the line of the foot inserted into the bootie.

Figure 6:
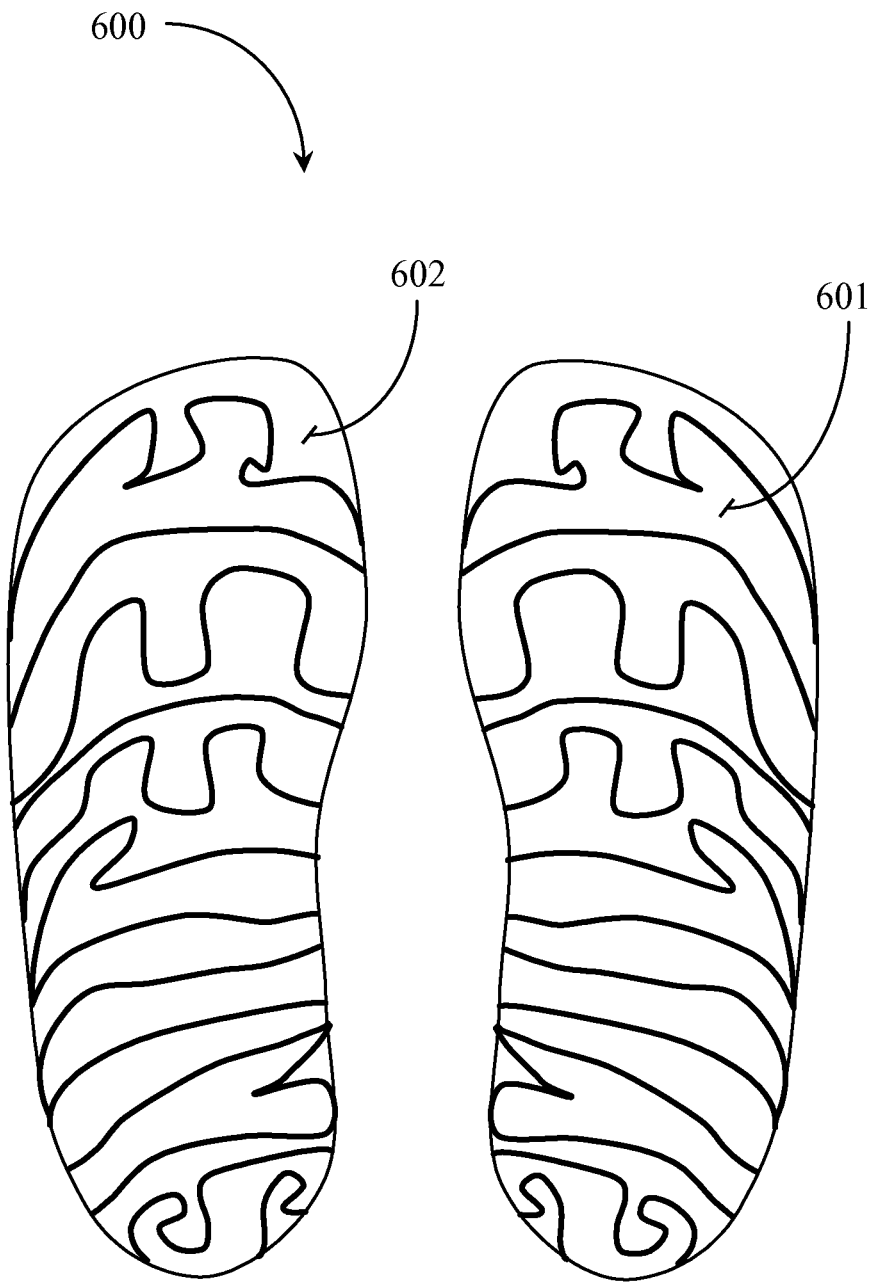
FIG. 6 is an elevation view of the soles of the foot coverings of FIG. 1 according to an embodiment of the present invention.

FIG. 6 is an elevation view of soles 600 of foot coverings of FIG. 1 according to an embodiment of the present invention. Soles 600 are analogous to soles fabricated from a resilient stretchable material referred to in FIG. 1 as material 107. In this embodiment the openings are hidden and are therefore not illustrated in this depiction.

Soles 600 may be printed or otherwise treated with one or more applications of a three dimensional rubberized ink 601 known as "Puff" ink in the art. Puff ink expands when heated to provide a three dimensional surface. In this example Puff ink 601 is applied according to a tread pattern over resilient sole material 602. The tread pattern might be a standard pattern tied to a specific version or batch of fabricated product where a next batch may include a different tread pattern. In one embodiment tread patterns might be patterns selected by user who order the sweatpants. In another embodiment a customer may create a unique (personalized) tread pattern through a graphics interface at the time of order of the product.

In one embodiment the tread pattern includes a word, symbol, or numerical indicia, created in mirror fashion so as to be readable by looking at an imprint of the sole of the bootie made on an imprintable ground surface. In one embodiment the tread pattern is unique to a user for the purpose of leaving a personalized imprint somewhere that might identify the wearer to other persons. In one embodiment users who find and photograph foot imprints left by a proprietary or custom tread pattern might produce such images to get discounts on purchases of the product. Functionally speaking, the raised tread pattern provides a superior non-skid surface for walking. The opening, if through the sole, may be hidden by rubberized flaps that may be overprinted with the tread pattern further obscuring the location of the opening in embodiments utilizing "hidden" openings.

It is noted herein that the openings are described as provided in foot coverings in at least one embodiment for sweatpants. This should not be construed as a limitation to the practice of the present invention. In one embodiment similar openings may be provided in mittens or hand coverings that might be sewn into or otherwise provided with a long-sleeved sweat shirt or jacket. In one embodiment sweatpants with openings in foot coverings and sweat shirt or jackets with openings in hand coverings may be provided and marketed as matching or paired items that might also be marketed separately.

It will be apparent to one with skill in the art that the clothing article of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

What is claimed is:

1. A clothing article comprising:

a waist band;

a seat portion;

two pant legs; and two foot coverings disposed one each at the end of the pant legs, each foot covering having portions including a toe, heel, sole and top formed to a shape to accept an entire human foot within each foot covering, the sole portion having a length in the direction from the heel to the toe portion, a width varying at different points along the length, an upper surface inside the foot covering and a bottom surface outside the foot covering;

an opening in the sole portion of each foot covering at a position along the length of the sole portion, the opening having a common width in the direction of the length of the sole portion, with a first straight edge and edge and a second straight edge, the opening proceeding substantially across the width of the sole portion, orthogonal to the length of the sole portion;

a first flap of material joined to the sole portion along the first edge of the opening, across the width of the sole portion, the first flap of material overlapping the opening; and a second flap of material joined to the sole portion along the second edge of the opening, across the width of the sole portion, the second flap of material overlapping both the first flap of material and the opening.

2. The clothing article of claim 1 wherein the waist band includes a drawstring for drawing the waist tight.

3. The clothing article of claim 1 wherein the soles of the foot coverings have an additional layer of resilient material on the outside of the foot covering.

4. The clothing article of claim 1 wherein the foot coverings are lined on the inside with sherpa material.

5. The clothing article of claim 1 where a portion of each pant leg is lined at least partially with fleece on the inside the fleece extending at least partially into the foot coverings.

6. The clothing article of claim 1 wherein the opening is disposed horizontally across the sole portion of each foot covering substantially centered between the heel and toe portions of the foot covering.

7. The clothing article of claim 1 further including a rubberized ink covering the sole of each foot covering.

8. The clothing article of claim 7 wherein the rubberized ink is applied according to a tread pattern.

9. The clothing article of claim 1 wherein the opening is disposed horizontally across the heel portion.

10. The clothing article of claim 1 wherein the first and second flaps are made of material stretchable in the direction across the width of the sole portion.

* * * * *